US008690471B2

(12) United States Patent
Wians et al.

(10) Patent No.: US 8,690,471 B2
(45) Date of Patent: Apr. 8, 2014

(54) CORNER CONNECTOR FOR SHELVING DISPLAY

(75) Inventors: Randy J. Wians, Hampshire, IL (US); Jeff A. Waterman, South Elgin, IL (US)

(73) Assignee: Batavia Container, Inc., Batavia, IL (US)

( * ) Notice: Subject to any disclaimer, the term of this patent is extended or adjusted under 35 U.S.C. 154(b) by 721 days.

(21) Appl. No.: 12/945,123

(22) Filed: Nov. 12, 2010

(65) Prior Publication Data

US 2012/0118844 A1 May 17, 2012

(51) Int. Cl.

| | |
|---|---|
| ***A47L 13/252*** | (2006.01) |
| *A47B 9/00* | (2006.01) |
| *A47B 47/00* | (2006.01) |
| *B65D 81/02* | (2006.01) |
| *A47B 96/06* | (2006.01) |
| *A47G 29/02* | (2006.01) |
| *A47F 5/00* | (2006.01) |

(52) U.S. Cl.

USPC ..... 403/231; 108/147.15; 108/180; 206/586; 248/220.1; 248/235; 211/183

(58) Field of Classification Search

USPC ..... 211/183, 207, 186, 187, 188; 108/147.11, 147.13–147.15, 147.17, 108/180, 186, 190, 192; 248/220.1, 235; 403/232.1, 231; 206/586

See application file for complete search history.

(56) References Cited

U.S. PATENT DOCUMENTS

| | | | | |
|---|---|---|---|---|
| 3,315,875 | A | 4/1967 | Praetorius | |
| 4,000,811 | A | 1/1977 | Hardison et al. | |
| 4,050,386 | A * | 9/1977 | Kellogg | 108/190 |
| 4,493,425 | A * | 1/1985 | Yoshida | 211/189 |
| 4,787,553 | A * | 11/1988 | Hoskins | 24/1 |
| 5,431,336 | A | 7/1995 | Clee | |
| 5,826,728 | A | 10/1998 | Sheffer | |
| 6,915,915 | B2 | 7/2005 | Nakajima | |
| 7,458,465 | B1 | 12/2008 | Dahl et al. | |
| 7,621,439 | B2 | 11/2009 | McClure | |
| 7,628,746 | B2 | 12/2009 | Varanasi | |
| 2005/0217543 | A1 * | 10/2005 | Hung | 108/186 |
| 2008/0067104 | A1 * | 3/2008 | Curnow et al. | 206/586 |
| 2008/0116156 | A1 * | 5/2008 | Park | 211/59.2 |

FOREIGN PATENT DOCUMENTS

DE 202004021286 * 6/2007 ..... B65D 85/86

OTHER PUBLICATIONS

Advertisement for "CC500 Corr-A-Clip Modular Shelf Supports" product on FFR-DSI website, http://www.ffr-dsi.com/ProductDetails.aspx?id=10000061&prodid=MI82022700. Last accessed Sep. 29, 2010.

(Continued)

*Primary Examiner* — Joshua J Michener
*Assistant Examiner* — Devin Barnett
(74) *Attorney, Agent, or Firm* — Chicago IP Law; Steven M. Evans

(57) ABSTRACT

A corner connector for a shelving display is provided comprising a planar base, an inner and an outer wall on and substantially perpendicular to the base, wherein a receptacle is formed between the inner and outer walls, a post on and substantially perpendicular to the base, and a first and a second end wall at opposing ends of the inner and outers walls, wherein said first and second end walls further define the receptacle. The corner connector further comprises a separator located within the receptacle to define an upper receptacle and a lower receptacle.

19 Claims, 11 Drawing Sheets

(56) References Cited

OTHER PUBLICATIONS

Advertisement for "Display Pole" product on FFR-DSI website, http://www.ffr-dsi.com/ProductDetails.aspx?id=100000004 &prodid=MI87079396. Last Accessed Sep. 29, 2010.

Advertisement for "Pole Gripper" product on FFR-DSI website, http://www.ffr-dsi.com/ProductDetails.aspx?id=100000004 &prodid=MI87020234. Last Accessed Sep. 29, 2010.

* cited by examiner

CORNER CONNECTOR FOR SHELVING DISPLAY

FIELD OF THE INVENTION

The present invention relates generally to connectors for shelving, and more particularly, to a corner connector for assembling a disposable, stackable shelving display.

BACKGROUND OF THE INVENTION

Disposable shelving displays are commonly used in stores to exhibit recently received merchandise. These temporary shelving displays are typically stackable and constructed of corrugated cardboard. Corrugated cardboard is strong, lightweight, relatively inexpensive, and recyclable. Such shelving displays can be quickly assembled, and then can be quickly dissembled and discarded, if desired.

While conventional disposable shelving displays have their advantages, they also have significant disadvantages. For example, disposable shelving displays are preformed for easy assembly. Thus, the dimensions of the shelves cannot be altered. If a merchant desires to use disposable display shelves for a temporary display of merchandise, the merchant is limited to placing merchandise on the shelves that can fit within the predetermined dimensions of the shelves. Products that are too tall for the shelving spaces cannot be placed on the shelves. Further, displaying merchandise on the shelves that is substantially shorter than the height of the shelves is a waste of space and inefficient.

Temporary shelving displays also suffering from a lack of merchandise visibility and durability. Corrugated cardboard shelving is generally enclosed on all sides except for the display side in order to provide the required strength and stability necessary in stackable shelves. Additionally, disposable shelving displays are susceptible to twisting or other torque forces because the corners of the shelves are only constructed of corrugated cardboard.

Accordingly, there exists a need for a disposable shelving display that provides adjustable dimensions, increased visibility for displayed merchandise, and increased strength and durability.

SUMMARY OF THE INVENTION

In view of the foregoing background, the present invention provides a disposable shelving display having a corner connector that comprises a planar base, an inner and an outer wall on and substantially perpendicular to the base, wherein a receptacle is formed between the inner and outer walls, a post on and substantially perpendicular to the base, and a first and a second end wall at opposing ends of the inner and outer walls, wherein said first and second end walls further define the receptacle. The corner connector further comprises a separator located within the receptacle to define an upper receptacle and a lower receptacle.

Vertical supports constructed of fiberboard corner are inserted into the upper and lower receptacles to build the stackable shelves. The vertical supports can be cut to a desired height for each shelf of the shelving display. Furthermore, the fiberboard corners for the vertical supports are commonly found as corner protectors on products shipped on wooden pallets or skids. Accordingly, a significant component of the invention, the vertical supports made of fiberboard corners, are readily available at very low cost, or even free, since the fiberboard corners are commonly shipped in the packaging of the received products.

Each corner of a corrugated shelf or tray having sidewalls is pushed down upon the pointed post of the corner support which punctures and passes through the bottom corner of the shelf. As the corner of the shelf is pushed down upon the post and towards the planar base of the corner support, the sidewalls of the shelf are securely wedged between the post and the inner wall of the corner support. Ribs on the inner wall of the corner connector function to further dig into the sidewalls of the shelf to further secure the shelf to the corner connector. Similarly, wedges located on the inner and outer walls of the upper and lower receptacles function also to dig into the vertical supports and secure the vertical supports within the corner connector.

The inner and outer walls of the corner support are formed into a right angle to prevent the assembled shelves from twisting due to torque forces. Furthermore, by using the vertical supports to support the height of the shelves instead of cardboard walls, the visibility of products being displayed upon the shelves is improved.

DETAILED DESCRIPTION OF THE PREFERRED EMBODIMENT

Figure 1:
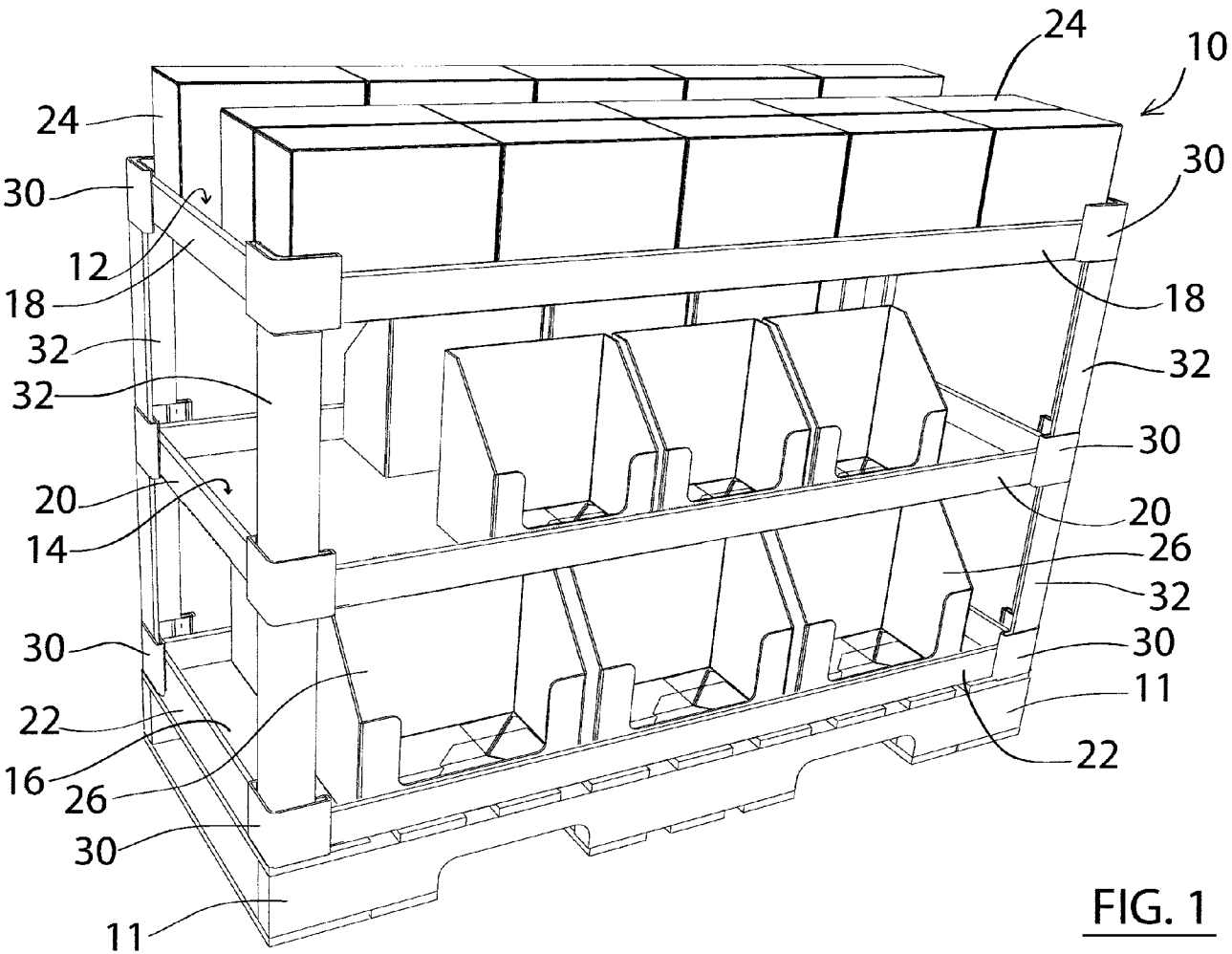
FIG. 1 is a perspective view of display shelves holding merchandise configured in accordance with the present invention.

Referring to the drawings, FIG. 1 shows a temporary or disposable shelving display 10 configured in accordance with the present invention. The shelving display 10 is configured of three stackable shelves 12,14,16. Of course, additional shelves may be added or removed from the shelving display 10 in accordance with the present invention. Each of the illustrated shelves or trays 12,14,16 includes sidewalls 18, 20, 22. The shelves 12,14,16 are preferably constructed of corrugated cardboard. The top shelf 12 is holding packaged products 24, and the middle and bottom selves 14,16 are holding empty display folders 26. The display folders 26 are preferably constructed of a paper material, such as corrugated cardboard. The packaged products 24 are preferably enclosed in lightweight paper boxes, similar to cereal boxes. Corner connectors 30 are located at the corners of each shelf 12,14, 16, and vertical supports 32 are inserted into the top and bottom of the corner connectors 30 to elevate each of the shelves 12,14,16 to the desired height. The entire shelving display 10 sits upon a wooden pallet or skid 11.

Figure 2:
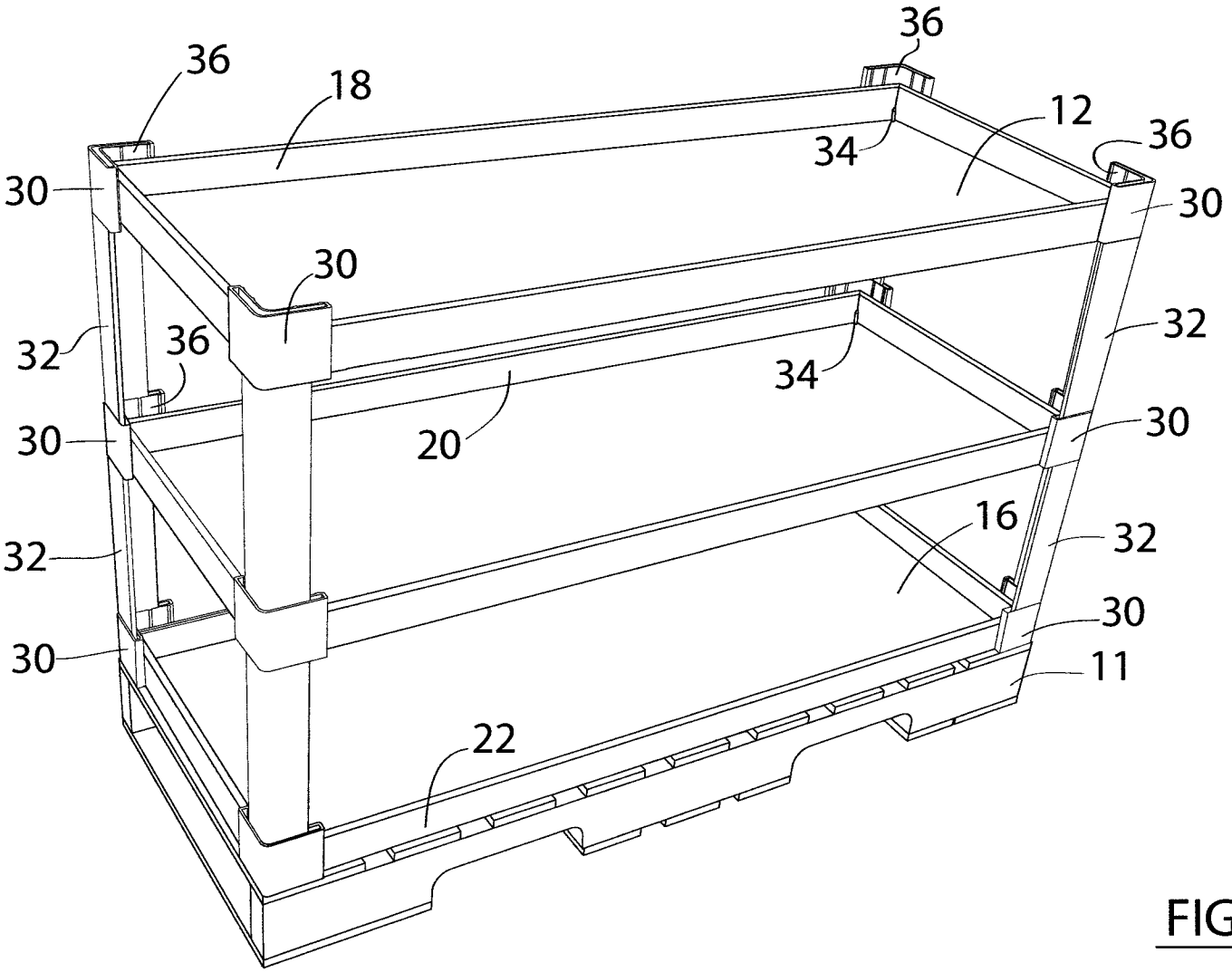
FIG. 2 is a perspective view of the display shelves of FIG. 1, without the merchandise in order to more clearly see the display shelves of the present invention.

FIG. 2 shows the shelving display 10 of FIG. 1, wherein the packaged products 24 and the display folders 26 have been removed. Illustrated are the shelves 12,14,16, the corner connectors 30, and the vertical supports 32. Now visible in FIG. 2, which was not visible in FIG. 1, is a post 34 located on each of the corner connectors 30.

In accordance with the present invention, the shelving display 10 is firmly held together by corner connectors 30 located at each corner of the shelves 12,14,16, and vertical supports 32, inserted into the top and bottom of the corner connectors 32, enable multiple shelves to be stacked on top of each other at whatever height a user desires by adjusting the heights of the vertical supports 32. The shelves 12,14,16 are firmly attached to the corner connectors 30 by pushing the shelves 12,14,16 down onto the posts 34 in order to puncture the bottom of the shelves 12,14,16. As the shelves are pushed down upon and punctured by the posts 34, the sides 18,20,22 of the shelves 12,14,16 are firmly held between the posts 34 and the inner walls 36 of the corner connectors 30. The vertical supports 32 are inserted into receptacles located on the top and bottom of the corner connectors 30. By assembling the shelving display 10 in this manner, increased visibility of items on the shelves from multiple angles is provided, durability and stability of the shelving display 10 is increased, and the height of each shelf is adjustable to a user's specific needs.

Figure 3:
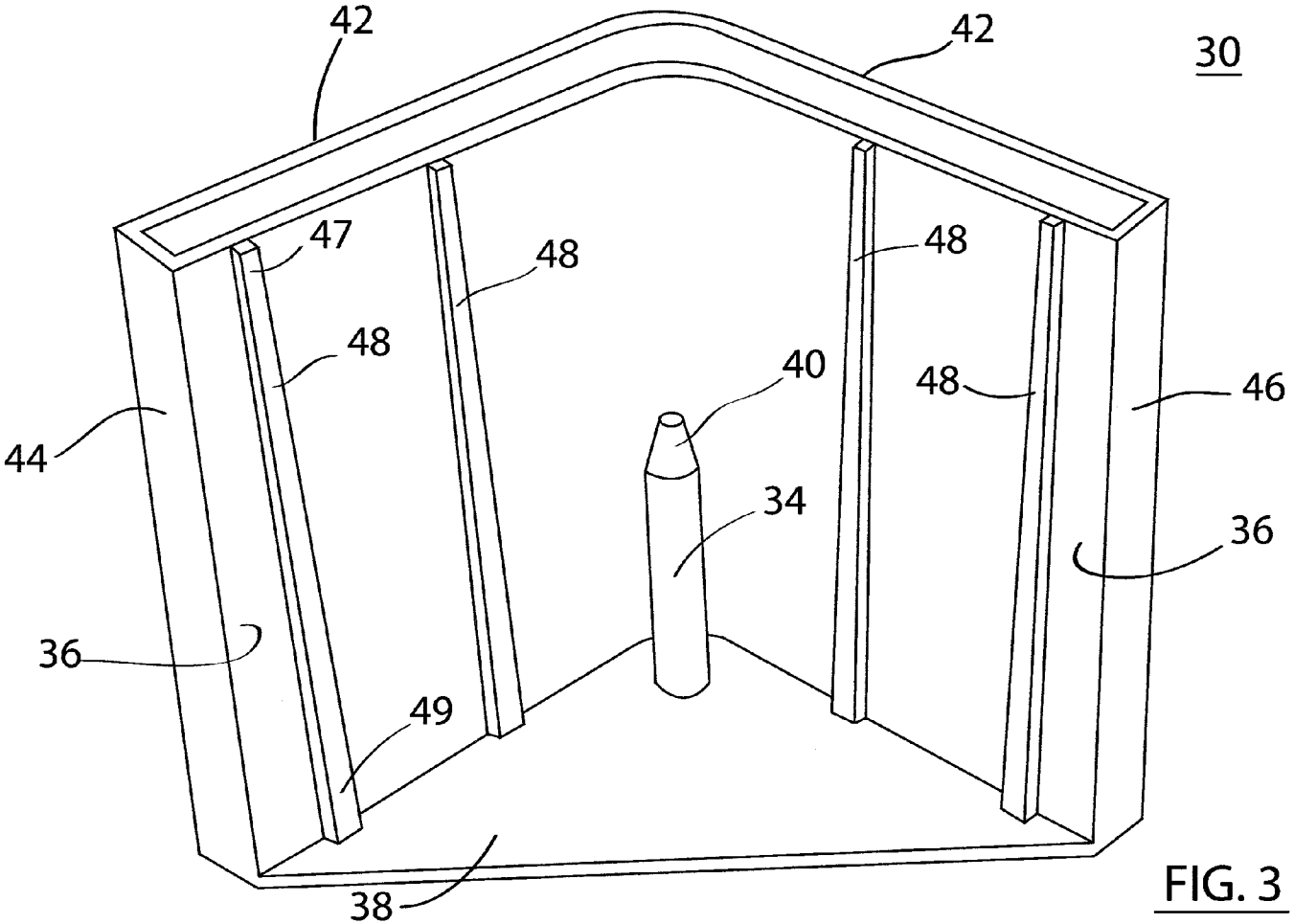
FIG. 3 is a perspective view of a corner connector configured in accordance with the present invention.

FIG. 3 is an enlarged perspective view of the corner connector 30 shown in FIGS. 1 and 2. The corner connector 30 includes a planar base 38 with an inner wall 36 connected substantially perpendicular to the planar base 38. A post 34 also is connected substantially perpendicular to the base 38. The top of the post 34 is formed into a cone or point 40. The corner connector 30 is preferably constructed of a molded polymer, such as a study plastic, into a single component. The corner connector 30 preferably can be constructed by injection molding of a plastic material, such as Polypropylene, or any injection grade molding plastic.

An outer wall 42 is connected substantially perpendicular to the base 38 and substantially parallel to the inner wall 36. A first end wall 44 and a second end wall 46 are connected to opposing ends of the inner and outer walls 36,42 to form or define a receptacle within the corner connector 30 for receiving a vertical support 32. Ribs 48 are located on the outside of the inner wall 36 facing the post 34. The ribs 48 are narrower at the top 47 of the ribs 48 and flare outward to be wider at the bottom 49 of the ribs 48. Similarly, the protruding height or thickness of the ribs 48 from the inner wall 36 increases from the top 47 to the bottom 49 of the ribs 48. In this manner, when a shelf corner is placed on top of the post 34 and punctured as the side walls of the shelf are driven between the ribs 48 and the post 34, the increasing width and the increasing height of the ribs 48 toward the planar base 38 will function to firmly dig in and wedge the side walls of the shelf between the inner wall 36 and the post 34.

Figure 4:
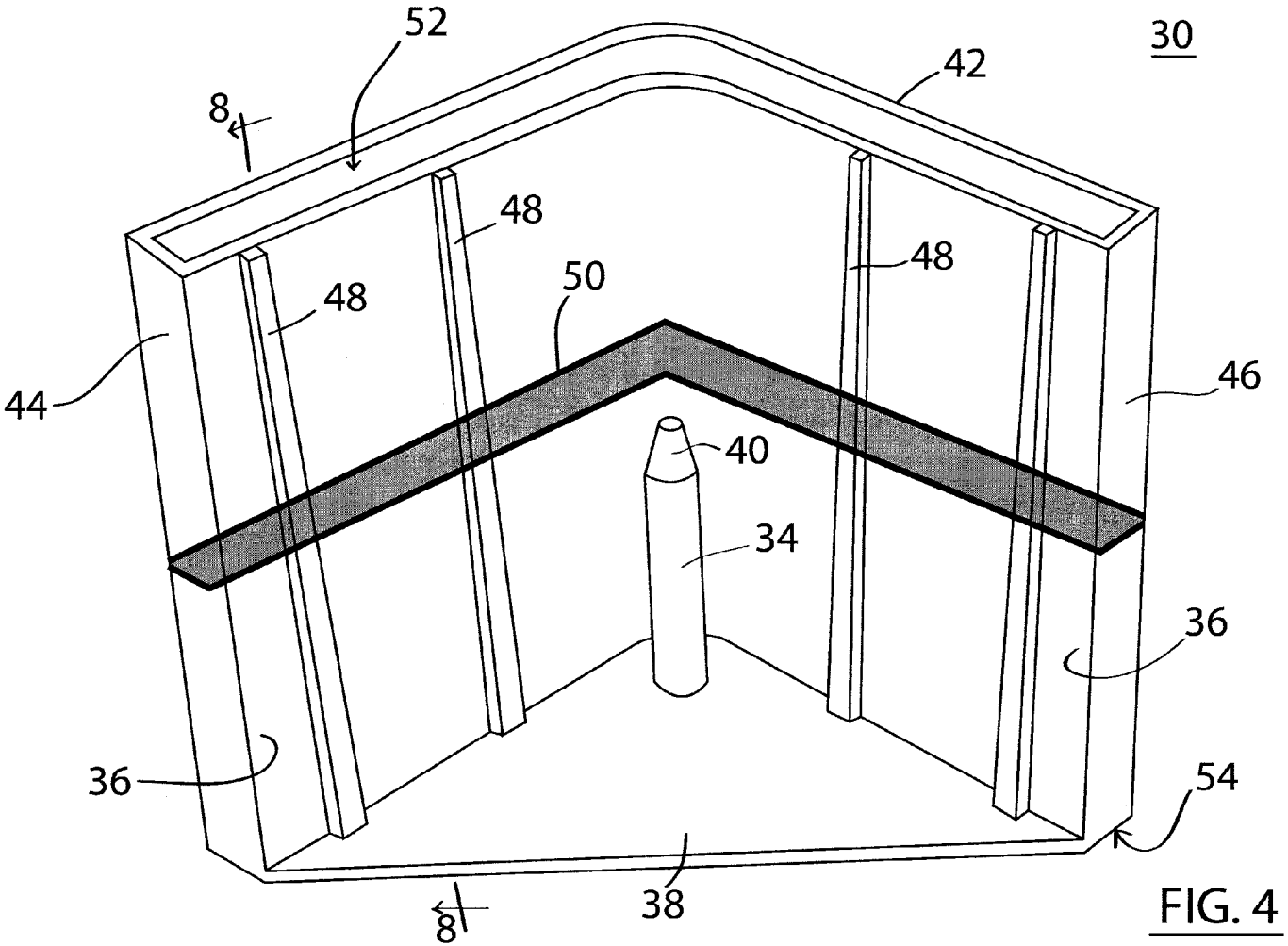
FIG. 4 is a perspective view of the corner connector of FIGS. 1-3 including a separator shown in shadow.

FIG. 4 is a perspective view of the corner connector 30 shown in FIGS. 1-3. FIG. 4 is identical to FIG. 3, except that FIG. 4 shows a separator 50 formed between the inner and outer walls 36,42. The separator is preferably a planar wall, but can be posts or other protrusions from the inner and outer walls 36,42 within the receptacle. The separator 50 is connected to the inner and outer walls 36,42, and the first and second end walls 44,46. The separator 50 preferably is a planar wall substantially perpendicular to and in contact with the inner and outer walls 36,42, and the first and second end walls 44,46. The separator 50, in combination with the inner and outer walls 36,42, and the first and second end walls 44,46, form an upper receptacle 52 and a lower receptacle 54 for receiving the vertical supports 32. The upper and lower receptacles 52,54 preferably have equal depths as determined by the separator 50.

Vertical supports 32 are inserted into the upper receptacle 52 and the lower receptacle 54 to assemble the shelving display 10 shown in FIGS. 1 and 2. The separator 50 is preferably a planar wall, but can be any protrusion from the inner and outer walls 36,42 that function as a stop point to prevent further insertion of a vertical support 32 beyond the depth of the upper or lower receptacles 52,54. The separator 50 is preferably formed as a unitary part of the corner connector 30.

Figure 5:
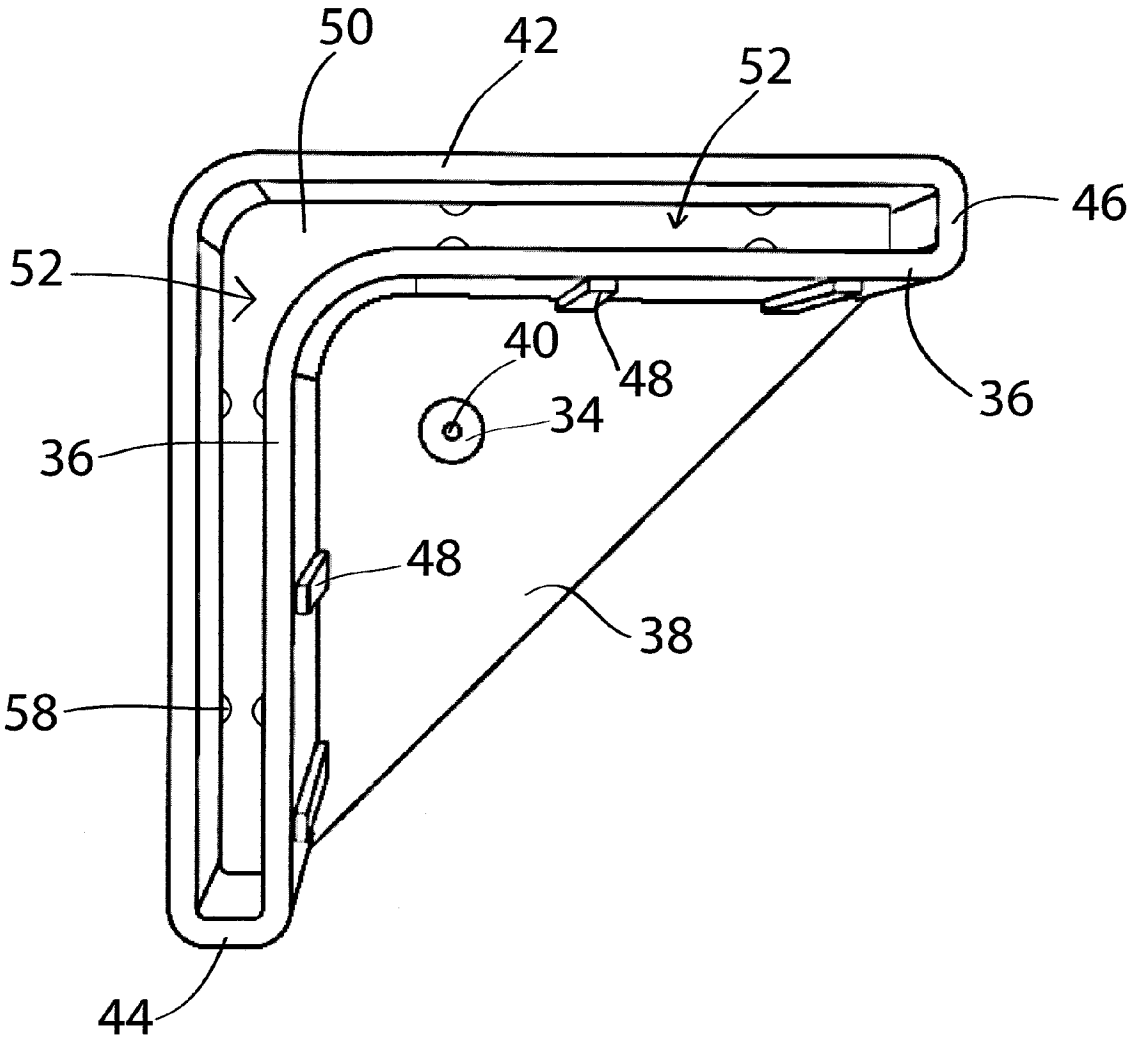
FIG. 5 is a top view of the corner connector shown in FIGS. 1-4.

FIG. 5 is a top view of the corner connector 30 shown in FIGS. 1-4. FIG. 5 provides a clear view of the upper receptacle 52 and the separator 50. The top of the cone 40 of the post 34 sitting on the planar base 38 also can be seen. Further shown within the upper receptacle 52 are wedges 58 attached to the inner and outer walls 36,42. The wedges 58, which are more clearly illustrated in FIG. 9, function to wedge against a vertical support 32 as the vertical support 32 is inserted into the upper receptacle 52. The wedges 58 are located in the lower portion of the upper receptacle 52, and similar to the ribs 48, increase in width and protrusion height from the inner and outer walls 36,42 from the top to the bottom of the wedges 58, wherein the bottom of the wedges 58 are closest to the separator 50. Wedges 58 also are located in the lower receptacle 54 and are attached to the inner and outer walls 36,42. The wedges 58 are in a mirror image formation of the wedges 58 in the upper receptacle 52, such that the wedges 58 in the lower receptacle 54 also increase in width and height as the wedge 58 extends towards the separator 50 at the bottom of the lower receptacle 54. The wedges 58 provide additional friction to secure vertical supports 32 inserted within the upper and lower receptacles 52,54 of the corner connector 30.

Figure 6:
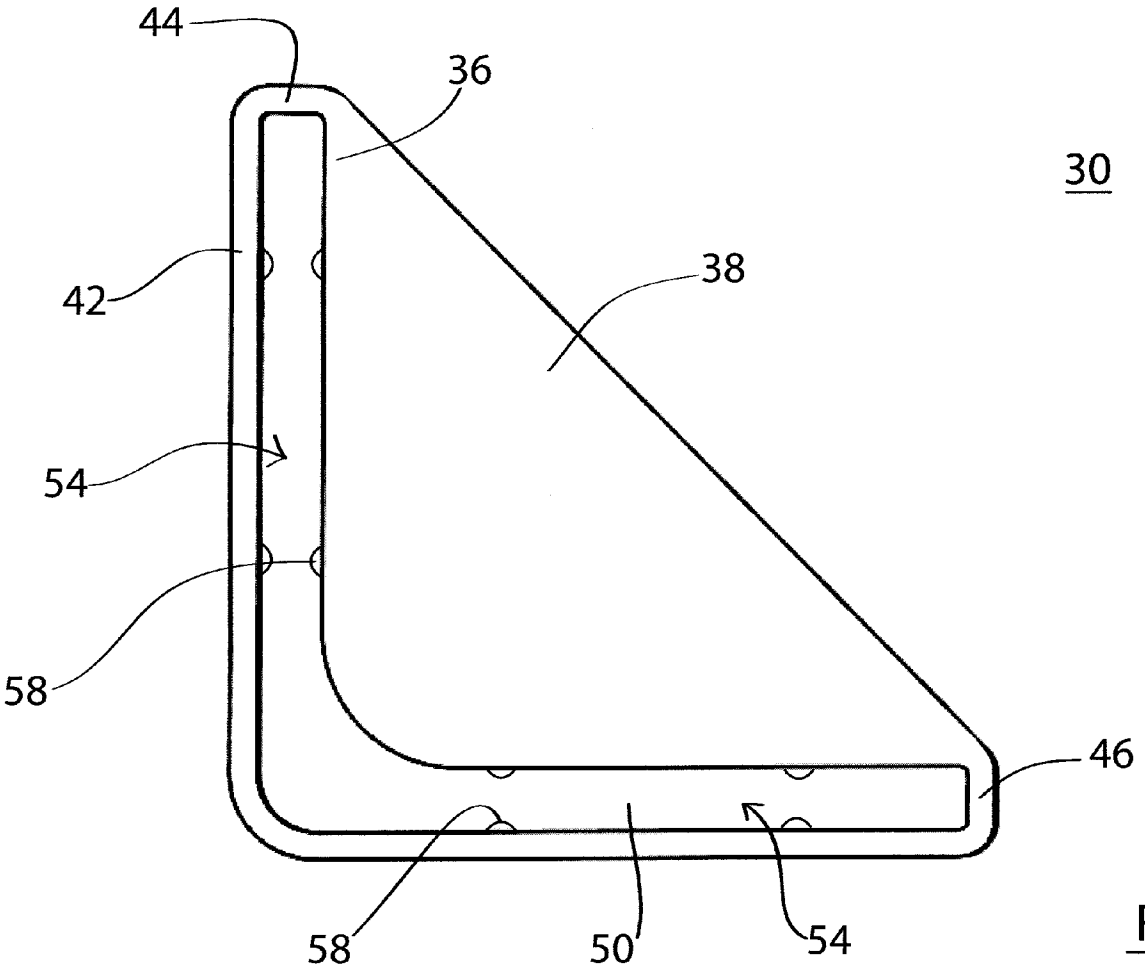
FIG. 6 is a bottom view of the corner connector shown in FIGS. 1-5.

FIG. 6 illustrates a bottom view of the corner connector 30 shown in FIGS. 1-5. FIG. 6 provides a clear view of the lower receptacle 54 and the wedges 58 contained therein. Also illustrated in FIG. 6 are bottom views of the planar base 38, the inner and outer walls 36,42, the first and second end walls 44,46, and the separator 50.

Figure 7:
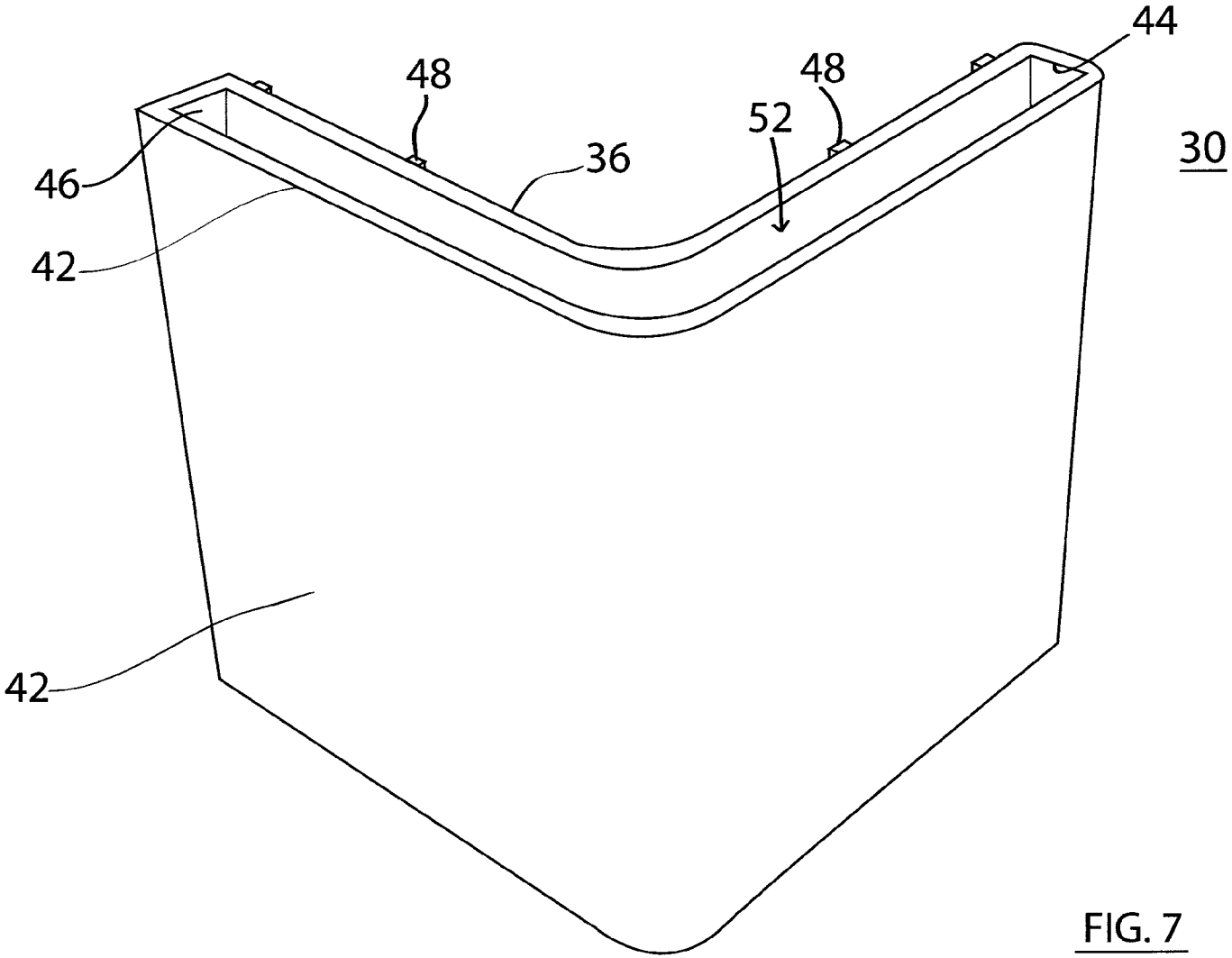
FIG. 7 is a perspective view of the outer wall of the corner connector shown in FIGS. 1-6.

FIG. 7 is a perspective view of the back of the corner connector 30 shown in FIGS. 1-6. Illustrated are the outer wall 42, the inner wall 36, the first and second end walls 44,46, the tops 47 of the ribs 48, and the upper receptacle 52.

Figure 8:
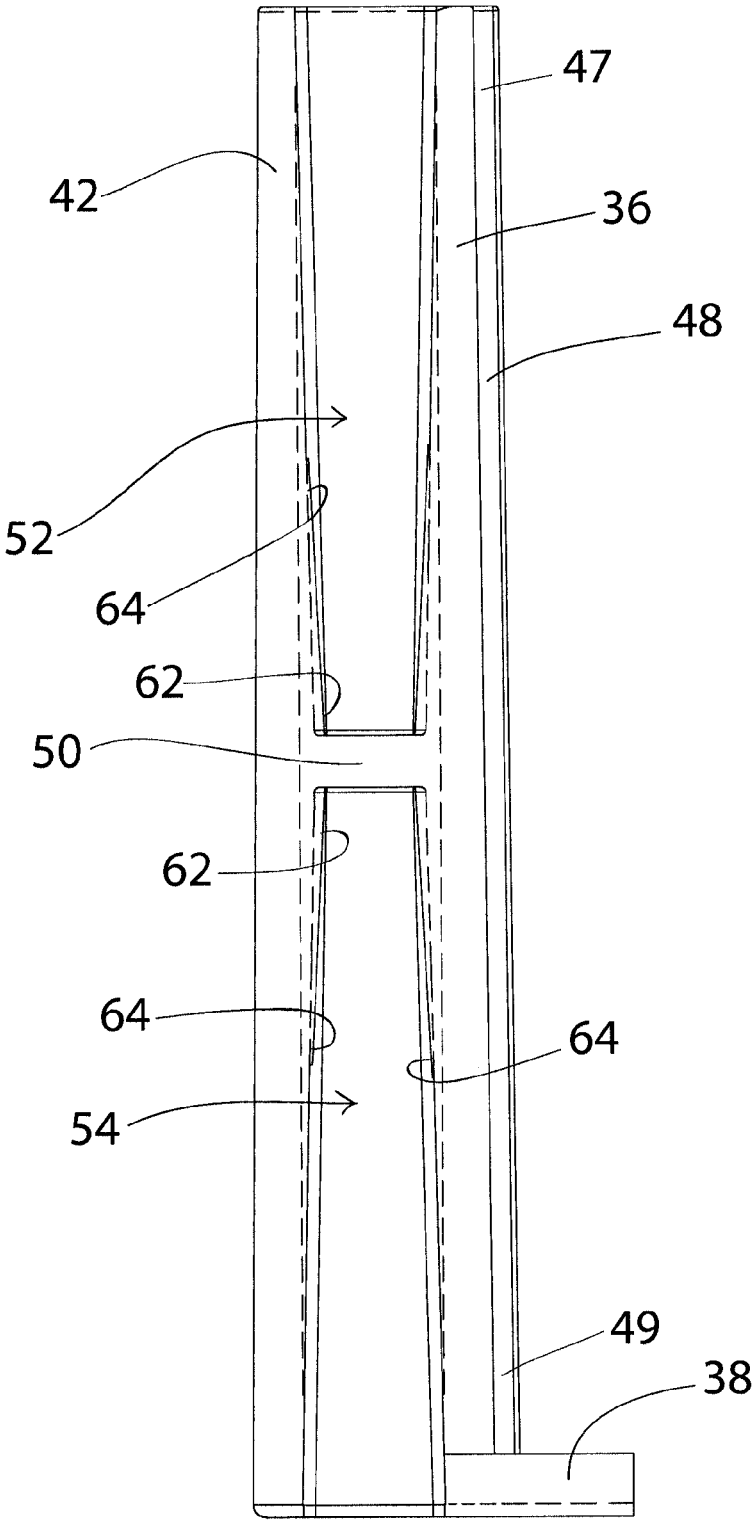
FIG. 8 is a cross-sectional view of the corner connector shown in and taken along line 8-8 of FIG. 5.

FIG. 8 is a cross-sectional view of the connector support 30 taken along and through line 8-8 of FIG. 4. Illustrated are the planar base 38, the inner wall 36, the outer wall 42, and the separator 50. Further illustrated are a rib 48 and the wedges 58 within the upper and lower receptacles 52,54. FIG. 8 illustrates how the wedges 58 are situated within the upper and lower receptacles 52,54. The bottom 62 of each wedge 58 is adjacent to the separator 50. The wedges 58 have a maximum height away from the inner and outer walls 36,42 within the receptacles 52,54 at the bottom of the upper and lower receptacle 52,54 and adjacent to the separator 50. The top 64 of each wedge 58, which is at the furthest portion of the wedges 58 from the separator 50, has the minimum height of each wedge 58. Thus, it can easily be seen that the width of the upper and lower receptacle 52,54, decreases via the wedges 58, the closer to the separator 50 at the bottom of the upper and lower receptacles 52,54.

Figure 9:
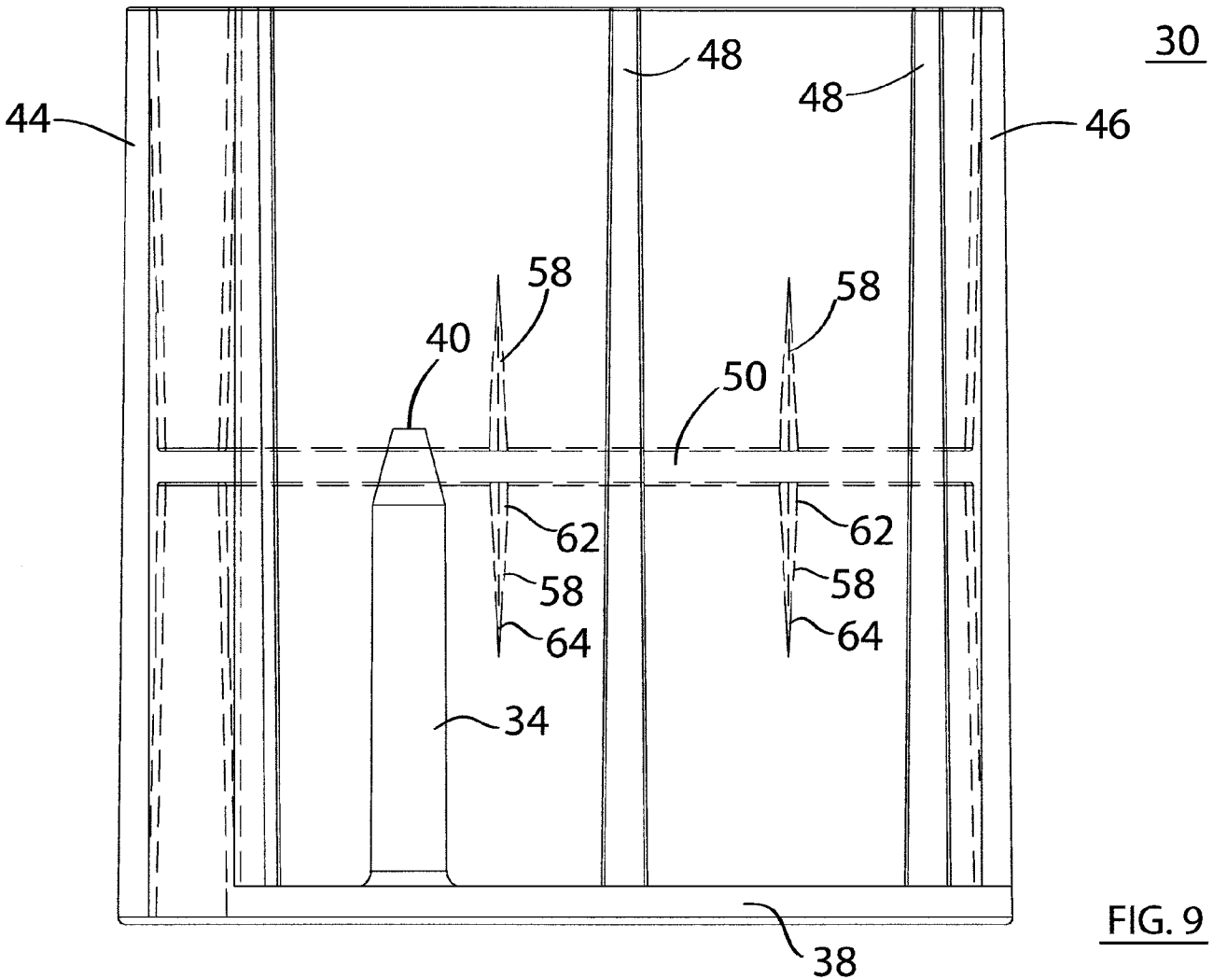
FIG. 9 is a transparent side view of the corner connector shown in FIGS. 1-8.

FIG. 9 is a transparent view of the corner connector 30 shown in FIGS. 1-8. Illustrated are the planar base 38, the inner and outer walls 36,42, the first and second end walls 44,46, and the separator 50. Also illustrated are the ribs 48 and the wedges 58. The post 34 with the cone 40 is further illustrated. FIG. 9 clearly shows how the width of each wedge 58 flares out at the bottom 62 of each wedge 58 and closer to the separator 50.

Figure 10:
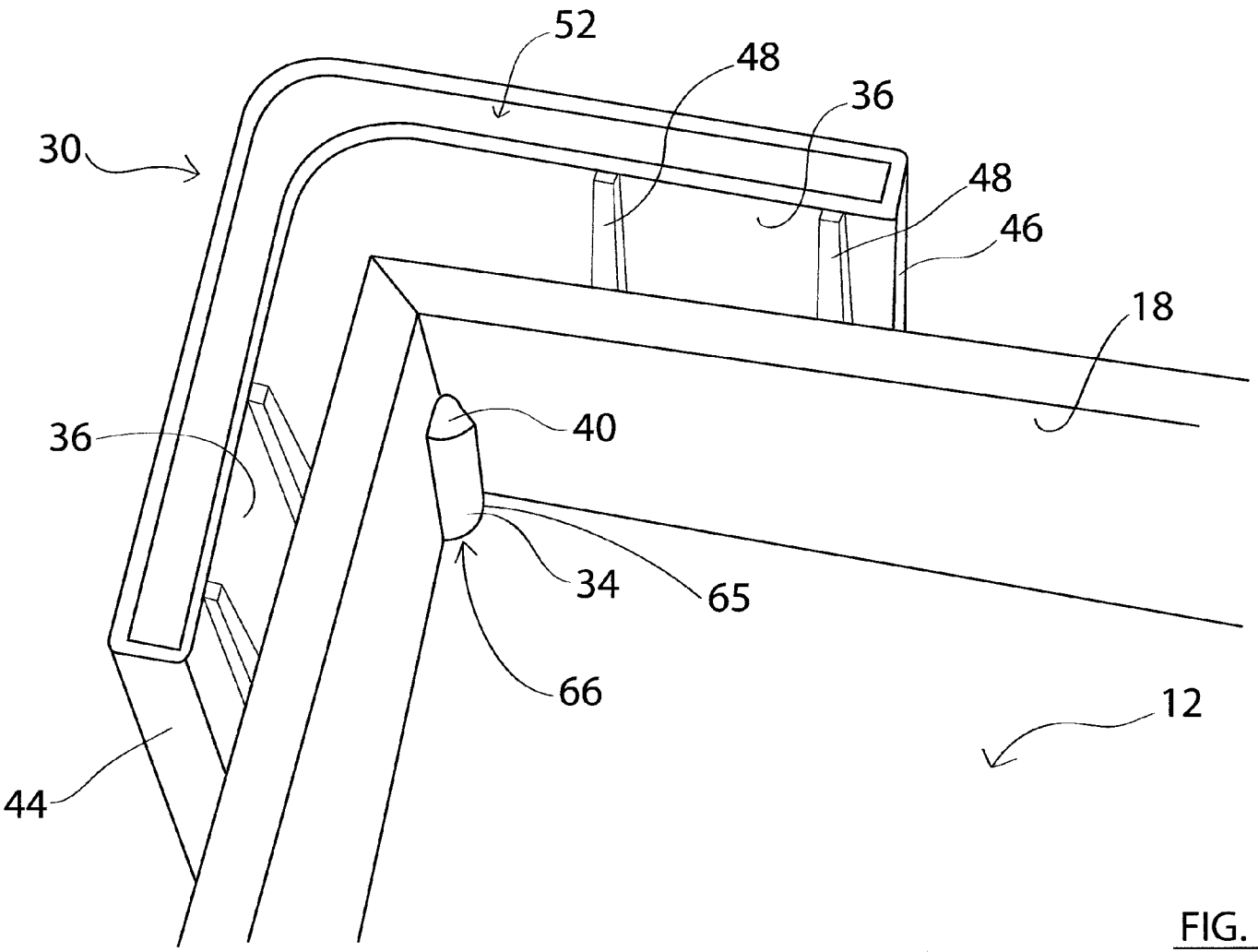
FIG. 10 is an enlarged perspective view of a corner connector and the top shelf shown in FIG. 2.

FIG. 10 illustrates a close up view of the shelf 12 attached to the corner connector 30 as shown in FIG. 2. The sidewalls 18 of the shelf 12 are shown being firmly held between the inner wall 36 and the post 34 of the corner connector 30. The shelf 12 is attached to the corner connector 30 by placing the corner of the shelf 12 over the cone or pointed top 40 of the post 34, and forcing the shelf 12 down upon the post 34 and through the shelf 12. The post 34 punctures a small aperture 65 in the corner area 66 of the shelf 12 as the shelf 12 is forced down over the post 34. In an alternative embodiment, a preformed aperture 65 is located in the corner area 66 of the shelf 12 to avoid having to puncture a hole in the shelf 12 as the corner of the shelf 12 is pushed down between the post 34 and the inner wall 36.

As the corner of shelf 12 is pushed down over the post 34, which then pushes through the shelf 12, the sidewalls 18 are wedged tightly between the ribs 48 of the inner wall 36 and the post 34. The increasing height of the ribs 48 at the bottom of the ribs 49 causes the sidewalls 18 to be wedged more tightly and securely as the shelf 12 is pushed all the way down over the post 34 to contact the planar base 38. The right angle formed by the inner wall 36 of the corner connector 30 prevents the shelf 12 from twisting after it has been pushed down all the way over the post 34.

Figure 11:
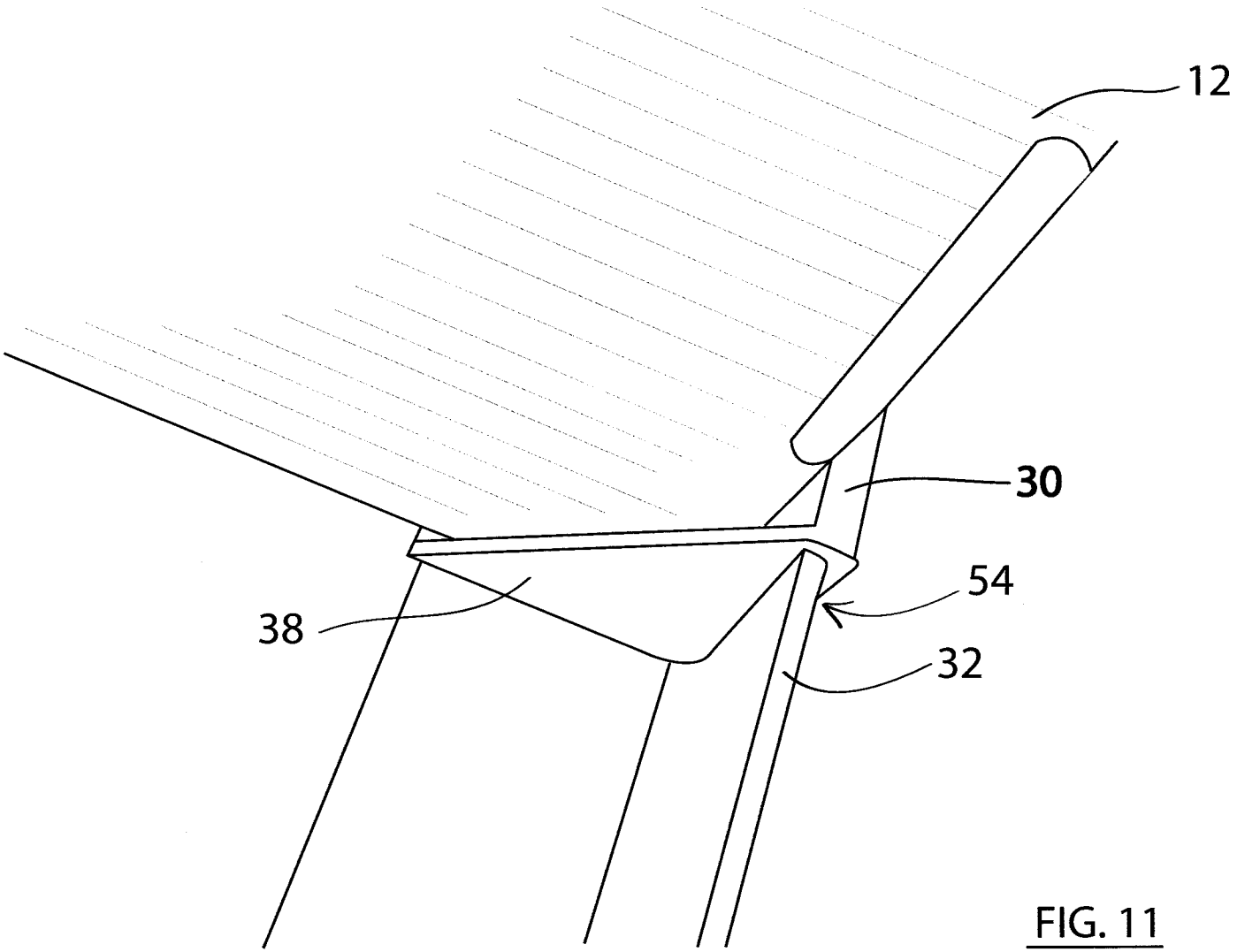
FIG. 11 is an enlarged perspective view of the bottom of the corner connector and top shelf shown in FIG. 10.

FIG. 11 illustrates a bottom view of the shelf 12, corner connector 30 and vertical support 32 shown in FIG. 2. The vertical support 32 is shown being inserted into the lower receptacle 54 of the corner connector 30. The vertical supports 32 are preferably corner fiberboards used to protect products being shipped on wooden pallets 11.

These corner fiberboards are typically constructed of multiple plies of paper, laminated together and formed into a rigid right angle. Corner fiberboards also are sometimes referred to as corner, edge, and angle protectors. One example of a commercially available corner fiberboard is the Angleboard® sold by ITW Angleboard, headquartered in Lake Zurich, Ill. Another example of a corner fiberboard is the Armorboard® sold by Armorboard® Packaging, located in York, Pa. Corner fiberboards are typically used for protecting products shipped on pallets, wherein the corner fiberboards are then generally thrown away upon receipt of the products. In this manner, the present invention enables this generally discarded packaging material to be used as an important element of the invention, and thus reduce costs for shelving displays.

Obviously many modifications and variations of the present invention are possible in the light of the above teachings. It is therefore to be understood that within the scope of the appended claims the invention may be practiced otherwise than as specifically described.

I claim as my invention:

1. A corner connector for a shelving display, comprising:

a planar base whose perimeter forms a right angle having a first leg, a second leg, and a right vertex angle corner between the first and second legs;

an inner wall connected to and perpendicular to the planar base;

an outer wall extending perpendicular to the planar base and parallel to the inner wall, wherein a receptacle is formed between the inner and the outer walls;

a post extending upwardly from and substantially perpendicular to the planar base, wherein the post has a spear configuration and is located between and equidistant from the first and the second legs of the right angle formed by the planar base so as to pass through a bottom of a shelf being placed upon the planar base, wherein the post holds sides of the shelf against the inner wall;

a first and a second end wall at opposing ends of the inner and outer walls and connecting the outer wall to the inner wall, wherein said first and second end walls further define the receptacle; and a horizontal separator wall located within the receptacle, connected to and extending between the inner and outer walls to separate the receptacle into an open-ended upper receptacle for receiving a first vertical support extending upwardly above the planar base and an open-ended lower receptacle for receiving a second vertical support extending downwardly below the planar base; wherein the open-ended lower receptacle is substantially located above the planar base.

2. The corner connector of claim 1, wherein the separator wall is attached to the inner and outer walls and the first and second end walls within the receptacle.

3. The corner connector of claim 1, further comprising:

at least one wedge attached to at least one of the inner and outer walls and contacting the separator wall within one of the upper and lower receptacles, wherein the at least one wedge is configured to retain at least one of the first and second vertical supports to be inserted into the upper and lower receptacle.

4. The corner connector of claim 1, further comprising:

at least one vertical rib attached to the inner wall extending substantially parallel to and facing the post, wherein the at least one rib is configured to retain walls of the shelf to be placed upon the planar base and against the inner wall.

5. The corner connector of claim 1, wherein the post has a circular cross-section and a top of the post is formed into a cone.

6. The corner connector of claim 4, wherein the at least one rib is tapered and increases in height from the inner wall as the at least one rib approaches the planar base.

7. The corner connector of claim 3, wherein the at least one wedge is tapered and increases in height from the inner or outer walls as the at least one wedge approaches the separator wall.

8. The corner connector of claim 4, wherein the at least one rib is tapered and increases in width as the at least one rib approaches the planar base.

9. The corner connector of claim 1, wherein the right vertex angle corner is curved.

10. The corner connector of claim 1, wherein the planar base has a top and a bottom, and the inner wall is located on the top of the planar base.

11. The corner connector of claim 1, wherein the post is one of only one post perpendicular to and on the planar base.

12. A corner connector for a shelving display, comprising:

a planar base having a top and a bottom;

an inner wall perpendicular to the planar base and connected to the top of the planar base;

an outer wall perpendicular to the planar base and parallel to the inner wall, wherein a receptacle is formed between the inner and the outer walls;

a post perpendicular to and on the top of the planar base, wherein the post has a spear configuration so as to pass through a bottom of a shelf being placed on the top of the planar base and hold sides of a shelf against the inner wall; and a horizontal separator wall located within the receptacle, connected to and extending between the inner and outer walls to separate the receptacle into an open-ended upper receptacle for receiving a first vertical support extending upwardly above the planar base and an open-ended lower receptacle for receiving a second vertical support extending downwardly below the planar base;

wherein the open ended lower receptacle is substantially located above the planar base.

13. The corner connector of claim 12, wherein a perimeter of the planar base forms a right angle having a first leg, a second leg, and a right vertex angle corner between the first and second legs, and the inner wall is connected to the perimeter of the planar base forming the right angle.

14. The corner connector of claim 13, wherein the post is one of only one post perpendicular to and extending upwardly from the top of the planar base, wherein the post is located between and equidistant from the first and the second legs of the right angle.

15. The corner connector of claim 12, further comprising:

a first and a second end wall at opposing ends of the inner and outer walls and connecting the outer wall to the inner wall, wherein the first and second end walls further define the receptacle.

16. A corner connector for a shelving display, comprising:

a planar base;

an inner wall perpendicular to and connected to the planar base, an outer wall perpendicular to the planar base and parallel to the inner wall, wherein a receptacle is formed between the inner and the outer walls; and a single post on and substantially perpendicular to the planar base, wherein the single post has a spear configuration so as to pass through a bottom of a shelf being placed upon the planar base, wherein the post holds sides of a shelf against the inner wall;

a horizontal separator wall located within the receptacle, connected to and extending between the inner and outer walls to separate the receptacle into an open-ended upper receptacle for receiving a first vertical support extending upwardly above the planar base and an open-ended lower receptacle for receiving a second vertical support extending downwardly below the planar base;

at least one vertical rib attached to the inner wall extending substantially parallel to and facing the post, wherein the at least one rib is configured to retain walls of the shelf to be placed upon the planar base and against the inner wall, wherein the at least one rib is tapered and increases in height from the inner wall as the at least one rib approaches the planar base.

17. The corner connector of claim 16, wherein the inner wall is connected along at least a portion of a perimeter of the planar base.

18. The corner connector of claim 16, wherein a perimeter of the planar base forms a right angle having a first leg, a second leg, and a right vertex angle corner between the first and second legs, wherein the inner wall is connected to the perimeter of the planar base, wherein the single post is located between and equidistant from the first and the second legs of the right angle formed by the planar base.

19. The corner connector of claim 16, further comprising:

a first and a second end wall at opposing ends of the inner and outer walls and connecting the outer wall to the inner wall, wherein said first and second end walls further define the receptacle.

* * * * *